US005188048A

United States Patent [19]

Vespoli et al.

[11] Patent Number: 5,188,048

[45] Date of Patent: Feb. 23, 1993

[54] FOUR MAN ROWING SHELL

[76] Inventors: Michael Vespoli, 604 W. Lake Ave., Guilford, Conn. 06437; Bruce Nelson, 4604 Alhambra St., San Diego, Calif. 92107; Carl Scragg, 1861 Montgomery Ave., Cardiff by the Sea, Calif. 92007

[21] Appl. No.: 799,176

[22] Filed: Nov. 27, 1991

[51] Int. Cl.[5] ..... B63B 1/00

[52] U.S. Cl. ..... 114/56; 114/347

[58] Field of Search ..... 114/347, 357, 343, 56

[56] References Cited

U.S. PATENT DOCUMENTS 2,744,042 5/1956 Pace ..... 114/357 X
3,611,461 10/1971 Wurzberger ..... 114/357
4,411,214 10/1983 Horiuchi ..... 114/347
5,016,557 5/1991 Miller ..... 114/347
5,067,426 11/1991 Vespoli et al. ..... 114/56

*Primary Examiner*—Sherman Basinger
*Attorney, Agent, or Firm*—DeLio & Associates

[57] ABSTRACT

A four-man rowing shell comprises an elongated hull made of a laminate of a fiber composite skin and having a pointed bow and stern and a hull surface tapering smoothly to a maximum beam and draft therebetween, the hull surface having a waterline length of at least 41.4 feet, a hull entry angle between about 3.85 and 4.70 degrees, a hull exit angle between about 4.78 and 5.84 degrees, a maximum draft below the waterline of between about 0.525 and 0.56 feet, inclusive, and a maximum beam of between about 1.48 and 1.60 feet, inclusive, when the shell is normally loaded.

14 Claims, 6 Drawing Sheets

FIG. 2
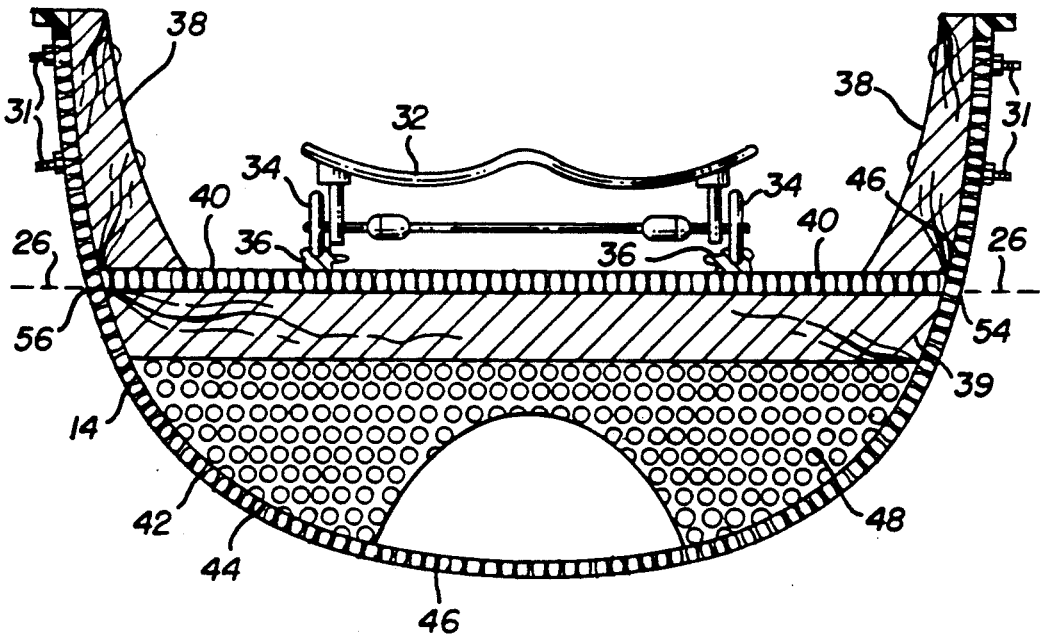
FIG. 4a
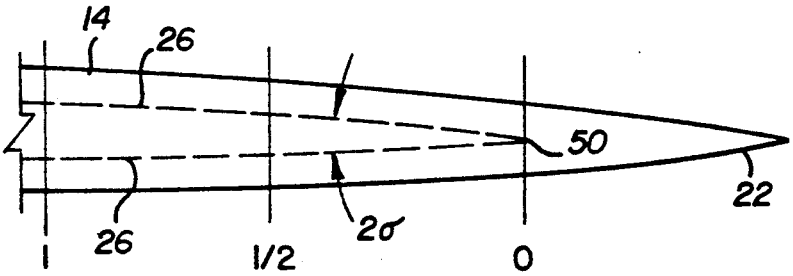
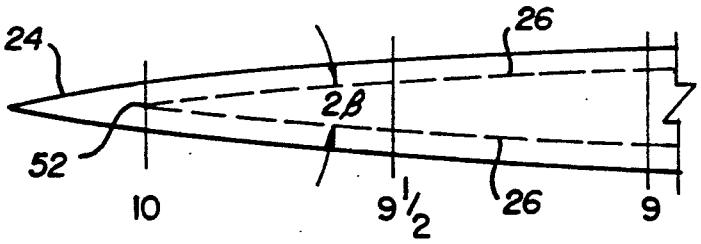
FIG. 4b

FOUR MAN ROWING SHELL

BACKGROUND OF THE INVENTION

This invention is directed to boat hull configurations and, in particular, hull configurations of rowing shells.

The performance of boat hulls depends on a number of factors, among them wave resistance, form resistance and frictional resistance. For boats which are propelled by rowing, other factors come into play, for example, oscillation in pitch and surge before, during and after the stroke of the oars through the water. For rowing shells or sculls in particular, the extreme slenderness of the hulls (in which the length to beam ratios can be up to 30 or more) pose special problems with regard to the aforementioned factors and to stability in roll. Other performance factors include the rigidity of the shell, the depth of the water in which the hull is to be used, and the expected race speed. Hull configuration can play a decisive role in dealing with one or more of these factors.

Hulls for rowing shells have advanced considerably in the past years, although significant differences still exist even between various models of hulls made for the same purpose. However, despite improved configurations and the use of advanced composite materials, there still exists a need for further hull improvement. Configurations which provide an advantage in one area often detract in other areas, with the result of little or no overall improvement. Given the relatively long distances of the courses over which races are run, for example, two kilometers or more, an improvement in hull configuration which results in an overall decrease in resistance of one to two percent can result in an improvement of one to two boat lengths or more over the length of the course, without any increase in effort on the part of the oarsmen. Furthermore, there is a need for increased stability in the hull configuration of racing shells along with any decrease in drag.

Given the needs in rowing competition and deficiencies in the prior art, it is therefore an object of this invention to provide an improved boat hull configuration for rowing shells.

It is another object of the present invention to provide an improved boat hull configuration which results in lower overall resistance in rowing shells.

It is a further object of the present invention to provide an improved boat hull configuration which may be utilized with existing materials and building techniques.

It is yet another object of the present invention to provide an improved rowing shell hull configuration which is especially suitable for four man rowing shells.

It is a further object of the present invention to provide an improved boat hull configuration which provides increased stability along with lower drag in rowing shells.

SUMMARY OF THE INVENTION

These and other objects, which will be readily apparent to those skilled in the art, are achieved in the present invention which provides a four man rowing shell comprising an elongated hull having a sharp, pointed, canoe-type bow and stern and a smoothly tapered hull surface therebetween. The hull surface may have the following cross-section areas, in square feet, below the waterline at stations spaced along the hull waterline when the shell is normally loaded:

| | | |
|---|---|---|
| station 0 | 0.000 | |
| station 0.5 | 0.052 | ±5% |
| station 1 | 0.147 | ±5% |
| station 2 | 0.355 | ±5% |
| station 3 | 0.505 | ±5% |
| station 4 | 0.587 | ±5% |
| station 5 | 0.617 | ±5% |
| station 6 | 0.589 | ±5% |
| station 7 | 0.497 | ±5% |
| station 8 | 0.348 | ±5% |
| station 9 | 0.159 | ±5% |
| station 9.5 | 0.060 | ±5% |
| station 10 | 0.000 | |

wherein station 0 signifies the fore-most point of the and station 10 signifies the aft-most point of the hull, along the waterline, and wherein a unit station spacing is one-tenth of the waterline length.

The hull waterline length is preferably between about 41.4 and 44.8 feet, inclusive, while the hull entry and exit angles may be between about 3.85° and 4.70°, and 4.78° and 5.84°, respectively. Other preferable parameters such as maximum beam, maximum draft, metacentric height and others are discussed further below.

The hull itself may be made of a laminate of a fiber composite skin over a core, such as a carbon fiber/-honeycomb laminate, or of natural materials such as wood.

BRIEF DESCRIPTION OF THE DRAWINGS

FIG. 2 is a cross sectional view perpendicular to the longitudinal axis of the shell as seen along lines 2—2 of FIG. 1.

FIG. 4*a* is a bottom plan view of the bow of the hull configuration of the present invention at the waterplane showing the waterline and the hull entry angle.

FIG. 4*b* is a bottom plan view of the stern of the hull configuration of the present invention at the waterplane showing the waterline and the hull exit angle.

DETAILED DESCRIPTION OF THE INVENTION

Reference is made herein to the accompanying FIGS. 1 through 6*b* which depict the boat hull configuration of the present invention in its preferred embodiment in a four man rowing shell. Like numerals are used to identify like features throughout the drawings.

Figure 1:
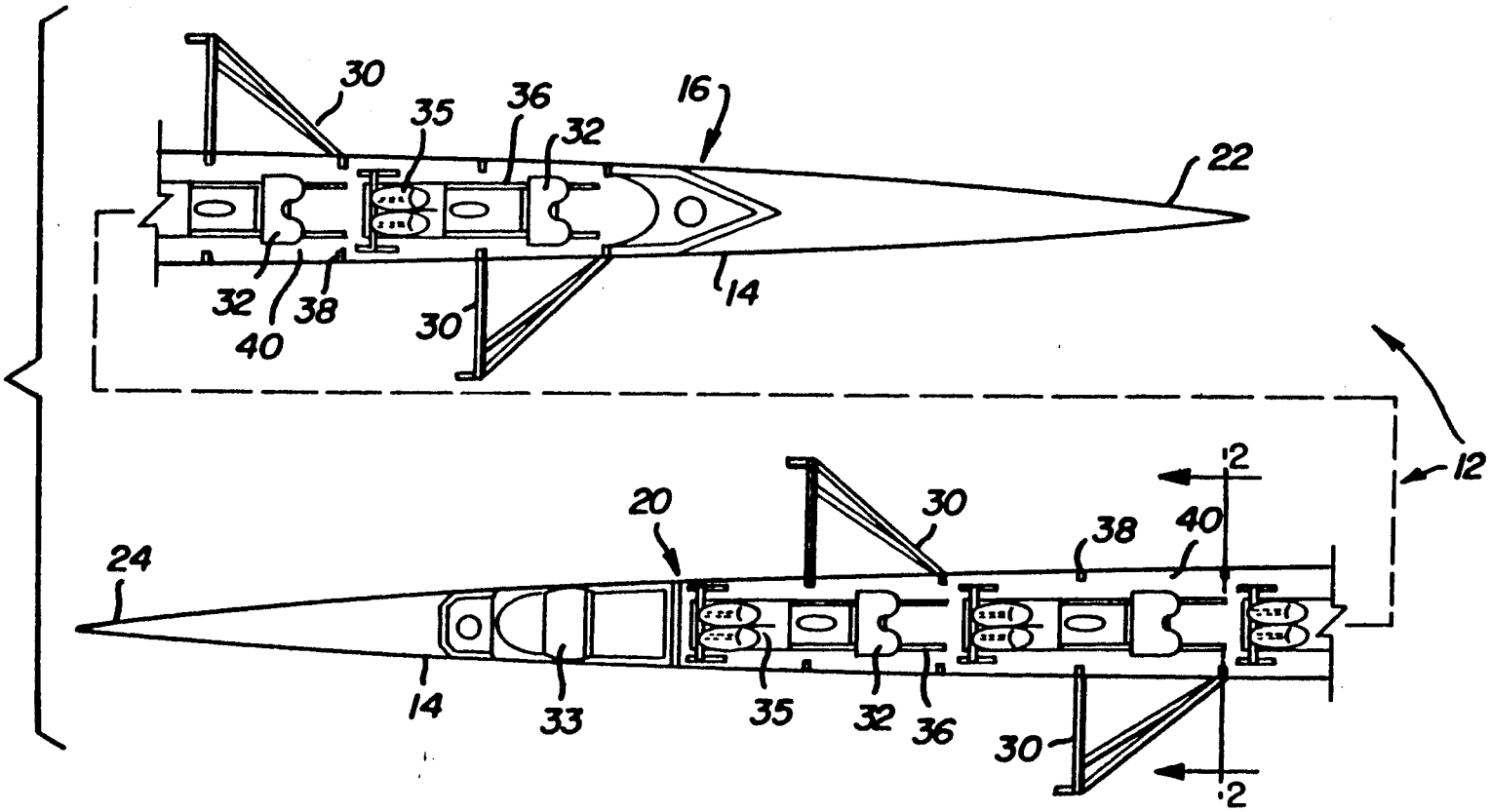
FIG. 1 is a top plan view of a four man rowing shell having the hull configuration of the present invention.

A top plan view of a four man racing shell 12 incorporating the hull configuration of the present invention is depicted in FIG. 1. The shell is constructed with a one-piece rigid hull 14 but is shown divided into linked bow and stern portions 16 and 20, respectively, for ease of drawing and description. Elongated hull 14 forms the basic under structure of shell 12 and extends in a smoothly tapered convex hull surface from the sharp, pointed canoe-type bow 22 to the maximum beam and draft in the midsection and back to the sharp, pointed, canoe-type stern 24. Mounted atop the hull are four linearly slidable rear facing seats 32 for the oarsmen. Each seat 32 has a corresponding adjacent footwell 35 and an adjustable rowing rigger 30 for the oar, the riggers 30 extending outward alternately on the starboard and port sides of the shell. A forward facing coxswain's seat 33 is provided near the stern of the shell. For ease of transport, the shell may be constructed of two sections which are joined before use.

Alternatively, the four man racing shell of the present invention may be constructed with two riggers, one on each side of the shell, at each seat. Also, the coxswain's seat may be positioned at the bow of the shell, or may be eliminated altogether.

As shown in further detail in the axial cross section of FIG. 2, hull 14 comprises a laminate of inner and outer carbon fiber skins, 42, 44, respectively, applied on either side of a honeycomb core made of a synthetic plastic honeycomb material such as that sold by E. I. DuPont de Nemours Co. under the trademark "Nomex". The carbon fiber skin/honeycomb core laminate in the hull configuration depicted provides a lightweight rigid structure running the entire length of the shell. Seat deck 40, supported by deck supports 39 and bulkheads 48 (spaced periodically along the length of the interior of the hull) provide additional rigidity to the hull whereby traditional bracing, such as a keel, becomes unnecessary. The seat decks 40 and bulkheads 48 may be made of honeycomb type laminates such as the Nomex® laminate as well.

Optionally, the hull and other structural components may be made of other laminates comprising any combination of carbon fiber, Kevlar® fiber (aromatic polyamide fiber available from DuPont), fiberglass, or any other fiber composites used in hull skin construction, with or without a core made of foam, or an alloy, synthetic or a cellulose honeycomb, or any other material typically used as a core in composite hull construction. A carbon fiber or other type keel may also be employed.

The adjustable rowing riggers 30 are attached by conventional hardware fittings 31 through the hull 14 to interior mounted shoulders 38. These shoulders 38, as well as the deck support 39, may be made of any suitable material such as white ash wood or any of the aforementioned laminates. The rowing riggers 30 are adjustable to the particular dimensions and requirements of the oar and oarsmen. Each seat 32 rides on wheels 34, attached to the seat undercarriage, which follow linear track sections 36 mounted on the top of seat deck 40. Hull 14 meets waterline 26 at opposite points 54 and 56.

Figure 3:
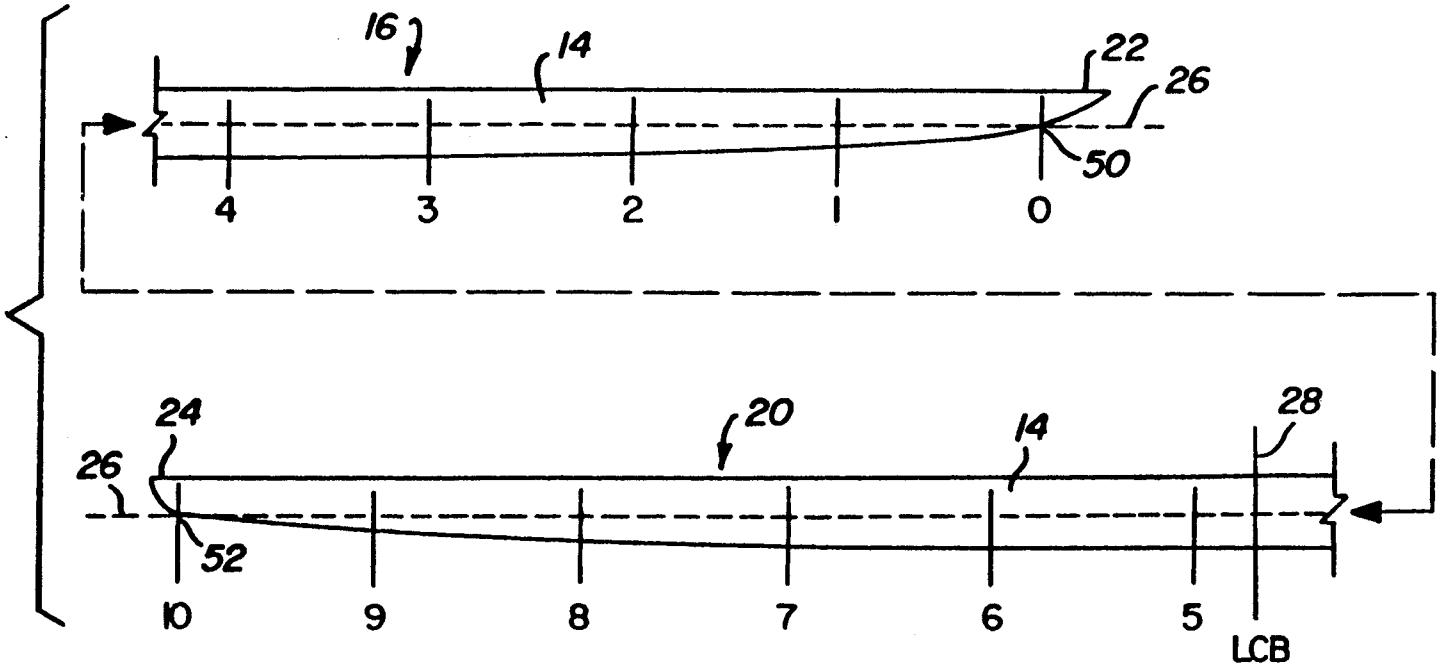
FIG. 3 is a side view of the hull depicted in FIG. 1, stripped of seats, riggers and other accessories, and which is marked with equally spaced station marks 0 through 10 along the length of the waterline.

A side view of the hull of the present invention is depicted in FIG. 3, without the seats, riggers or other accessories depicted in FIGS. 1 and 2. The hull 14 is again shown as linked bow and stern portions 16 and 20, respectively. Waterline 26 is shown in a phantom line superimposed along the side of hull 14. The length of hull 14 is sectioned in equally spaced segments denoted as stations 0 through 10 wherein station 0 coincides with the beginning or fore-most point 50 of the hull waterline near bow 22. Station 10 coincides with the end or aft-most point 52 of the hull waterline.

The unit spacing for the stations depicted in FIG. 3 is equal to one-tenth the length of the waterline ("LWL"). The location of waterline 26 with respect to hull 14 is determined by, normal, industry-accepted displacement or loading of the shell. For the four man shell 12 depicted in the drawings, this loading or displacement is about 1050 lbs. This displacement places the shell 12 in the "heavyweight" class of four man shells, as contrasted with the "lightweight" class of four man shells in which no coxswain is used and the maximum weight is about 160 lbs. per person. The position marked "LCB" (28) on the hull is the center of buoyancy of the shell.

FIGS. 4*a* and 4*b* show the entry and exit angles, respectively, of the hull configuration of the present invention in relation to the hull stations depicted in FIG. 3. In FIG. 4*a*, the waterline 26 is shown superimposed on a plan view of hull 14 at stations 0, ½ and 1 near bow 22. The straight lines between the fore-most point 50 along the hull waterline and the two points along the hull waterline at station ½ form the angle $2\tau$(sigma), in which $\tau$ is termed the entry angle of the hull. In FIG. 6*b*, the waterline 26 is shown superimposed on a plan view of hull 14 at stations 9, 9 ½ and 10 near stern 24. The straight lines between the aft-most point 52 at station 10 along the hull water line and the two points along the hull waterline at station 9 ½ form the angle $2\beta$(beta) in which $\beta$ is termed the exit angle of the hull 14. The entry and exit angles, $\tau$ and $\beta$, respectively, are determined as follows:

$$\alpha = \arctan[(\tfrac{1}{2}\text{ hull width @ sta }\tfrac{1}{2})/(\text{LWL}/20)]$$

$$\beta = \arctan[(\tfrac{1}{2}\text{ hull width @ sta }9\tfrac{1}{2})/(\text{LWL}/20)]$$

The selection of entry and exit angles of hull 14 contribute to the decreased overall resistance of the hull. In general, it is preferred that the entry angle sigma be greater than about 3.85° and less than about 4.50°, more preferably greater than about 4.0° and less than about 4.3°, inclusive, and the exit angle beta be greater than about 4.78° and less than about 5.84°, more preferably greater than about 5.0° and less than about 5.5°, inclusive.

In Table 1 there is set forth the characteristics of the preferred hull of the present invention identified as "Vespoli NSV4", as compared to prior art hulls identified as "Janousek", and "Empacher". The term "LWL" refers to the length of the waterline, i.e., the distance along the waterline between points 50 and 52 as seen in FIG. 3; the term "BWL" refers to the maximum beam at the waterline, i.e., the maximum width or breadth of the hull along the waterline; and the term "Thull" refers to the draft of the hull below the waterline, i.e., the distance between the waterline and the lowermost point on hull 14. The entry and exit angles correspond to the angles sigma and beta as shown in FIGS. 4*a* and 4*b*, respectively, and are identified by the terms "ENTRY" and "EXIT". The displacement of the hull is given by the term "VOL" and the wetted surface area of the hull, below the waterline, is given by the term "WS". The term "GMt" in Table 1 refers to the distance of the transverse metacenter above the waterplane of the hull with the center of gravity assumed to be at the waterplane (waterline) height.

TABLE 1

| COMPARISON OF ROWING SHELL CHARACTERISTICS | Model: | | |
|---|---|---|---|
| | Janousek | Empacher | Vespoli NSV4 |
| SECTION AREAS ($ft^2$) | | | |
| Station 0 | 0.000 | 0.000 | 0.000 |
| 0.5 | 0.080 | 0.069 | 0.052 |
| 1 | 0.187 | 0.164 | 0.147 |
| 2 | 0.356 | 0.353 | 0.355 |
| 3 | 0.483 | 0.484 | 0.505 |
| 4 | 0.571 | 0.568 | 0.587 |
| 5 | 0.596 | 0.592 | 0.617 |
| 6 | 0.573 | 0.556 | 0.589 |
| 7 | 0.521 | 0.475 | 0.497 |
| 8 | 0.411 | 0.349 | 0.348 |
| 9 | 0.223 | 0.164 | 0.159 |
| 9.5 | 0.103 | 0.064 | 0.060 |
| 10 | 0.000 | 0.000 | 0.000 |
| LWL (ft.) | 41.823 | 44.362 | 43.113 |
| BWL (ft.) | 1.47 | 1.654 | 1.517 |
| Thull (ft.) | 0.522 | 0.502 | 0.530 |
| Cp | 0.656 | 0.624 | 0.614 |
| Cm | 0.776 | 0.713 | 0.769 |
| Cwp | 0.705 | 0.664 | 0.710 |
| ENTRY (deg.) | 3.83 | 4.665 | 4.27 |
| EXIT (deg.) | 4.893 | 4.973 | 5.313 |
| VOL ($ft^3$) | 16.348 | 16.388 | 16.357 |
| WS ($ft^2$) | 64.447 | 65.744 | 63.869 |
| GMt (ft) | 0.135 | 0.235 | 0.190 |

NOTE: UNIT STATION SPACING IS 1/10 LWL. FOR GMt, CENTER OF GRAVITY IS ASSUMED TO BE AT THE WATERPLANE (WATERLINE) HEIGHT.

The metacenter is the point at the intersection of the centerline and a vertical line through the center of buoyancy (as seen in an axial or transverse cross-section) when the boat is inclined at small angles of heel, up to about 7–10° from vertical. GMt metacentric height is a measure of roll stability, with higher values denoting better stability and lower values denoting poorer stability. Preferably, the GMt value will be no less than about 0.160 ft., more preferably between about 0.170 and 0.210 ft., for good roll stability.

The other parameters given in Table 1 are denoted by the terms "Cp", "Cm", and "Cwp" which refer to the prismatic coefficient, the midship section coefficient and waterplane coefficient, respectively. These parameters, as well as the others given in Table 1, are well known in the hull design and naval architecture art, and are defined in such volumes as *Principles of Naval Architecture,* John P. Comstock, Ed., Society of Naval Architects and Marine Engineers (1967) the disclosure of which is hereby incorporated by reference.

The dimensions and parameters given in Table 1 for the present invention may be varied somewhat to achieve one or more of the advantages of the preferred embodiment of hull 14. The length of the waterline of hull 14 is preferably between about 41.4 and 44.8 feet. The hull section areas, below the waterline, may be varied from the amounts given by up to plus-or-minus ten (10) percent, preferably no more than plus-or-minus five (5) percent, most preferably no more than about plus-or-minus three (3) percent. Also, the maximum beam may be between about 1.48 and 1.60 feet, the draft between about 0.525 and 0.56 feet and the wetted surface area of the hull between about 62.0 and 64.3 square feet.

Figure 5:
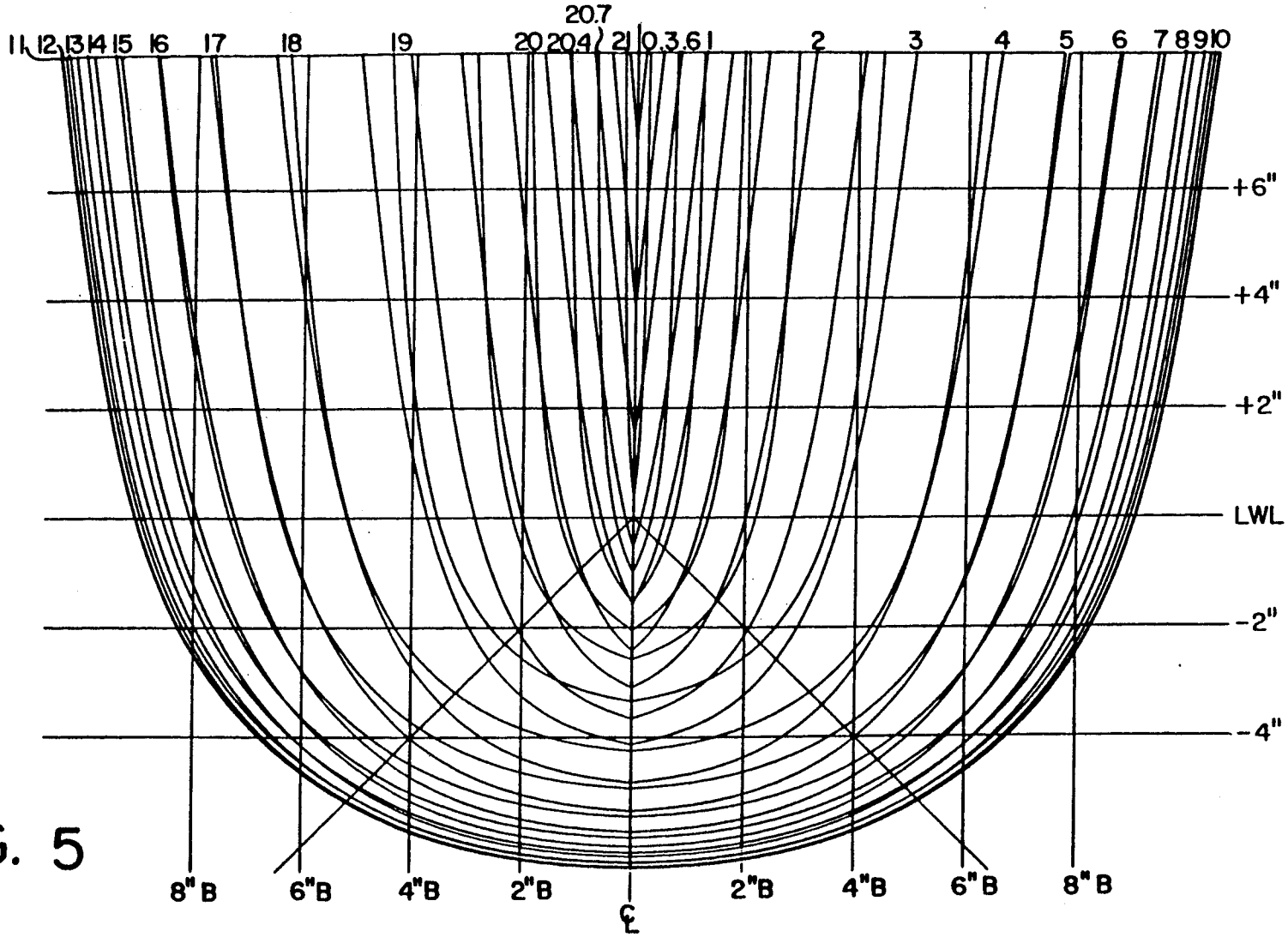
FIG. 5 is a graphical representation of the axial cross-sections along the length of the preferred hull configuration of the present invention.

To further describe the hull configuration, graphical representations of the hull exterior surface axial cross-sections of the preferred Vespoli NSV4 hull are shown to scale in FIG. 5. FIG. 5 shows the sections of the hull, in scale, from sections 1 through section 20. The position of each section along the hull is shown in Table 2, below. These section markings do not correspond to the station markings in FIG. 3 and Table 1, discussed previously.

TABLE 2

| Model: Vespoli NSV4 | Distance from Bow (in.) | |
|---|---|---|
| Section | 0 | 2.0 |
| | 1 | 15.7 |
| | 2 | 42.2 |
| | 3 | 68.7 |
| | 4 | 95.2 |
| | 5 | 121.7 |
| | 6 | 148.2 |
| | 7 | 174.7 |
| | 8 | 201.2 |
| | 9 | 227.7 |
| | 10 | 254.2 |
| | 11 | 280.7 |
| | 12 | 307.2 |
| | 13 | 333.7 |
| | 14 | 360.2 |
| | 15 | 386.7 |
| | 16 | 413.2 |
| | 17 | 439.7 |
| | 18 | 466.2 |
| | 19 | 492.7 |
| | 20 | 519.2 |
| | 21 | 533.4 |

In FIG. 5, each individual hull section is labeled along the top horizontal line of the graph above one end of the corresponding section line. Sections labeled in fractional amounts correspond to sections between whole (unit) numbers. The centerline of the hull is indicated by the central vertical line labeled "CL" and the space between each vertical line to the right and left corresponds to a horizontal distance of 2.0 inches on the actual size NSV4 hull 14. The horizontal line labeled "LWL" corresponds to the loaded waterline (26) of the hull, and the space between each horizontal line above and below corresponds to a vertical distance of 2.0 inches on the actual size NSV4 hull 14.

Figure 6A:
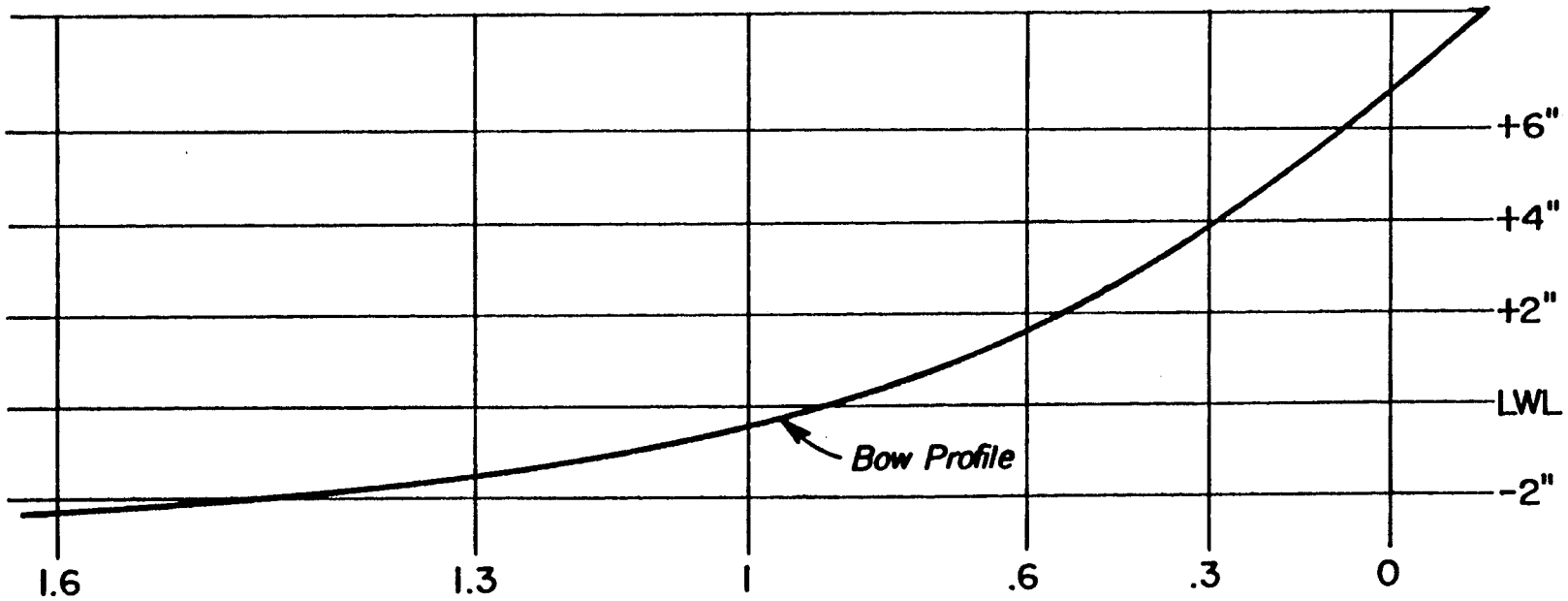
FIG. 6*a* is a graphical representation of the side elevational profile of the hull bow configuration shown in FIG. 5.
Figure 6B:
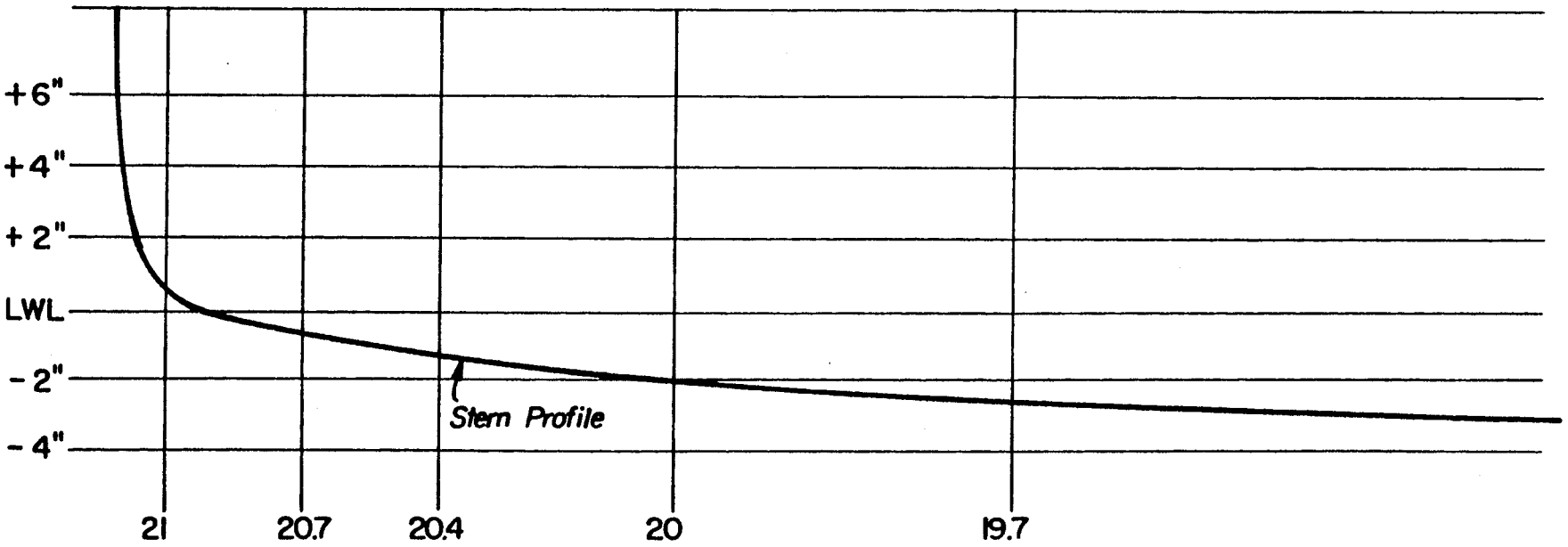
FIG. 6*b* is a graphical representation of the side elevational profile of the hull stern configuration shown in FIG. 5.

FIG. 6*a* depicts the graphical representations of the side elevational profile of the preferred NSV4 hull bow configuration, while FIG. 6*b* depicts the same type of elevational profile of the stern configuration for the preferred NSV4 hull. The vertical lines are marked with the section numbers as shown in FIG. 5. The waterline is marked "LWL", and the space between each horizontal line above and below corresponds to a vertical distance of 2.0 inches on the actual size NSV4 hull 14.

The hull configuration described herein has been shown to provide increased performance under actual course conditions, without any significant loss in roll stability. The advantages of this hull configuration may be seen under actual pitching and surging conditions and under a variety of water depths, including relatively shallow conditions between about 3 and 10 meters. The preferred embodiment of the hull configuration of the present invention has been found to be up to one to two percent faster than prior art configurations, depending on velocity. This may result in an advantage of up to one to two shell lengths over a typical 2000 meter course without any additional effort in rowing. In addition to having less drag, the hull configuration of the present invention has also been found to have greater stability than prior art configurations. The hull may be easily constructed using conventional techniques to achieve its advantages.

While this invention has been described with reference to specific embodiments, it will be recognized by those skilled in the art that variations are possible without departing from the spirit and scope of the invention, and that it is intended to cover all changes and modifications of the invention disclosed herein for the purposes of illustration which do not constitute departure from the spirit and scope of the invention.

Having thus described the invention, what is claimed is:

1. A rowing shell comprising an elongated hull having a bow and stern and a smoothly tapered hull surface therebetween, said hull surface having a waterline length between about 41.4 and 44.8 feet and the following cross-section areas, in square feet, below the waterline at stations spaced along the hull waterline when the shell is normally loaded:

| | | |
|---|---|---|
| station 0 | 0.000 | |
| station 0.5 | 0.052 | ±5% |
| station 1 | 0.147 | ±5% |
| station 2 | 0.355 | ±5% |
| station 3 | 0.505 | ±5% |
| station 4 | 0.587 | ±5% |
| station 5 | 0.617 | ±5% |
| station 6 | 0.589 | ±5% |
| station 7 | 0.497 | ±5% |
| station 8 | 0.348 | ±5% |
| station 9 | 0.159 | ±5% |
| station 9.5 | 0.060 | ±5% |
| station 10 | 0.000 | |

wherein station 0 signifies the fore-most point of the hull, and station 10 signifies the aft-most point of the hull, along the waterline, and wherein a unit station spacing is one-tenth of the waterline length.

2. The rowing shell of claim 1 wherein the entry angle of the hull surface, as measured at the fore-most point of the hull along the waterline, is between about 3.85° and 4.70°, inclusive.

3. The rowing shell of claim 1 wherein the exit angle of the hull surface, as measured at the aft-most point of the hull along the waterline, is between about 4.78° and 5.84°, inclusive.

4. The rowing shell of claim 1 wherein the metacentric height is at least about 0.160 ft.

5. The rowing shell of claim 1 wherein the maximum beam of the hull along the waterline when the shell is normally loaded to a displacement of about 1050 lbs. is between about 1.48 and 1.60 feet, inclusive.

6. The rowing shell of claim 1 wherein the surface area of the hull below the waterline when the shell is normally loaded is between about 62.0 and 64.3 square feet, inclusive.

7. The rowing shell of claim 1 wherein the metacentric height of said shell is between about 0.17 and 0.21 feet.

8. The rowing shell of claim 1 wherein the hull is made of a laminate of a fiber composite skin over a core material.

9. The rowing shell of claim 1 wherein the hull surface has approximately the following cross-section areas, in square feet, below the waterline at said stations along the hull waterline:

| | |
|---|---|
| station 0 | 0.000 |

-continued

| | |
|---|---|
| station 0.5 | 0.052 |
| station 1 | 0.147 |
| station 2 | 0.355 |
| station 3 | 0.505 |
| station 4 | 0.587 |
| station 5 | 0.617 |
| station 6 | 0.589 |
| station 7 | 0.497 |
| station 8 | 0.348 |
| station 9 | 0.159 |
| station 9.5 | 0.060 |
| station 10 | 0.000 |

10. A four-man rowing shell comprising an elongated hull having a bow and stern and a hull surface tapering smoothly to a maximum beam and draft therebetween, said hull being made of a laminate of a fiber composite skin over a core material, said hull surface having a waterline length of at between about 41.4 and 44.8 feet when the shell is normally loaded to a displacement of about 1050 lbs., an entry angle as measured at the fore-most point of the hull along the waterline of between about 3.85° and 4.70°, inclusive, and an exit angle as measured at the aft-most point of the hull along the waterline of between about 4.78° and 5.84°, inclusive, and wherein said hull surface has the following cross-section areas, in square feet, below the waterline at stations spaced along the hull waterline when the shell is normally loaded:

| | | |
|---|---|---|
| station 0 | 0.000 | |
| station 0.5 | 0.052 | ±3% |
| station 1 | 0.147 | ±3% |
| station 2 | 0.355 | ±3% |
| station 3 | 0.505 | ±3% |
| station 4 | 0.587 | ±3% |
| station 5 | 0.617 | ±3% |
| station 6 | 0.589 | ±3% |
| station 7 | 0.497 | ±3% |
| station 8 | 0.348 | ±3% |
| station 9 | 0.159 | ±3% |
| station 9.5 | 0.060 | ±3% |
| station 10 | 0.000 | |

wherein station 0 signifies the fore-most point of the hull, and station 10 signifies the aft-most point of the hull, along the waterline, and wherein a unit station spacing is one-tenth of the waterline length, and said shell having a metacentric height of between about 0.160 and 0.210 ft., inclusive.

11. The rowing shell of claim 10 wherein the entry angle of the hull surface, as measured at the fore-most point of the hull along the waterline, is between about 4.0° and 4.5°, inclusive, and the exit angle of the hull surface, as measured at the aft-most point of the hull along the waterline, is between about 5.0 and 5.5°, inclusive.

12. The rowing shell of claim 10 wherein the maximum beam of the hull along the waterline when the shell is normally loaded to a displacement of about 1050 lbs. is between about 1.48 and 1.60 feet, inclusive.

13. The rowing shell of claim 10 wherein the surface area of the hull below the waterline when the shell is normally loaded is between about 62.0 and 64.3 square feet, inclusive.

14. A four-man rowing shell comprising an elongated hull having a bow and stern and a hull surface tapering smoothly to a maximum beam and draft therebetween, said hull surface having a waterline length of at between about 41.4 and 44.8 feet when the shell is normally loaded to a displacement of about 1050 lbs., an entry angle as measured at the fore-most point of the hull along the waterline of between about 3.85° and 4.70°,inclusive an exit angle as measured at the aft-most point of the hull along the waterline of between about 4.78° and 5.84°, inclusive, said hull surface having the following cross-section areas, in square feet, below the waterline at stations spaced along the hull waterline when the shell is normally loaded:

| | | |
|---|---|---|
| station 0 | 0.000 | |
| station 0.5 | 0.052 | ±10% |
| station 1 | 0.147 | ±10% |
| station 2 | 0.355 | ±10% |

-continued

| | | |
|---|---|---|
| station 3 | 0.505 | ±10% |
| station 4 | 0.587 | ±10% |
| station 5 | 0.617 | ±10% |
| station 6 | 0.589 | ±10% |
| station 7 | 0.497 | ±10% |
| station 8 | 0.348 | ±10% |
| station 9 | 0.159 | ±10% |
| station 9.5 | 0.060 | ±10% |
| station 10 | 0.000 | |

wherein station 0 signifies the fore-most point of the hull, and station 10 signifies the aft-most point of the hull, along the waterline, and wherein a unit station spacing is one-tenth of the waterline length, and said shell having a metacentric height of between about 0.160 and 0.210 ft., inclusive.

* * * * *